US009541264B2

(12) United States Patent
Xu

(10) Patent No.: US 9,541,264 B2
(45) Date of Patent: Jan. 10, 2017

(54) LIGHT-EMITTING DIODE (LED) LIGHTING FIXTURE

(71) Applicant: DONGGUAN JIASHENG LIGHTING TECHNOLOGY CO., LTD., Dongguan, Guangdong Province (CN)

(72) Inventor: Shuisheng Xu, Dongguan (CN)

(73) Assignee: DONGGUAN JIASHENG LIGHTING TECHNOLOGY CO., LTD., Dongguan, Guangdong Province (CN)

( * ) Notice: Subject to any disclaimer, the term of this patent is extended or adjusted under 35 U.S.C. 154(b) by 285 days.

(21) Appl. No.: 14/339,565

(22) Filed: Jul. 24, 2014

(65) Prior Publication Data

US 2015/0323162 A1 Nov. 12, 2015

(30) Foreign Application Priority Data

May 9, 2014 (CN) ..... 2014 1 0196554

(51) Int. Cl.

| | |
|---|---|
| ***F21V 7/04*** | (2006.01) |
| ***F21V 17/16*** | (2006.01) |
| ***F21V 1/00*** | (2006.01) |
| ***F21V 17/02*** | (2006.01) |
| ***F21S 8/00*** | (2006.01) |
| ***F21S 8/06*** | (2006.01) |
| ***F21V 17/10*** | (2006.01) |
| *F21Y 101/02* | (2006.01) |
| *F21V 29/76* | (2015.01) |

(52) U.S. Cl.

CPC ..... *F21V 17/16* (2013.01); *F21S 8/00* (2013.01); *F21S 8/003* (2013.01); *F21S 8/06* (2013.01); *F21V 1/00* (2013.01); *F21V 17/02* (2013.01); *F21V 17/10* (2013.01); *F21V 17/102* (2013.01); *F21V 29/763* (2015.01); *F21Y 2101/02* (2013.01)

(58) Field of Classification Search

CPC ..... F21S 8/00; F21S 8/03; F21S 8/06; F21V 29/004; F21V 17/02; F21V 1/00; F21V 17/10; F21V 29/763; F21V 2101/02

USPC ..... 362/296.01, 296.05, 296.07, 373, 294

See application file for complete search history.

(56) References Cited

U.S. PATENT DOCUMENTS

| | | | | |
|---|---|---|---|---|
| 7,661,854 | B1 * | 2/2010 | Yang | F21K 9/00 362/249.02 |
| D681,859 | S * | 5/2013 | Beregszaszi | D26/74 |
| 2008/0101063 | A1 * | 5/2008 | Koike | F21S 8/088 362/231 |
| 2008/0285271 | A1 * | 11/2008 | Roberge | F21S 8/033 362/235 |

(Continued)

*Primary Examiner* — Bryon T Gyllstrom

(74) *Attorney, Agent, or Firm* — Jackson IPG PLLC; Demian K. Jackson

(57) ABSTRACT

The present invention relates to a light-emitting diode (LED) lighting fixture, which comprises a radiator, a housing and an LED module mounted at the bottom of the radiator, and further comprises a lamp holder being fixed on the top of the radiator and running through the housing, an elastic element clamped between the lamp holder and the housing, and a lamp shade encircling the LED module. The radiator includes a chassis, a body extended upwards from the chassis, and a plurality of radiating fins; one side of the radiator close to the bottom is provided with a recess.

10 Claims, 8 Drawing Sheets

(56) References Cited

U.S. PATENT DOCUMENTS

| | | | | |
|---|---|---|---|---|
| 2009/0097262 | A1* | 4/2009 | Zhang | F21S 8/026<br>362/364 |
| 2009/0154160 | A1* | 6/2009 | Li | F21S 8/026<br>362/249.02 |
| 2010/0053950 | A1* | 3/2010 | Higuchi | F21S 8/026<br>362/234 |
| 2010/0259919 | A1* | 10/2010 | Khazi | F21S 8/026<br>362/84 |
| 2012/0127741 | A1* | 5/2012 | Osada | F21K 9/30<br>362/373 |

* cited by examiner

LIGHT-EMITTING DIODE (LED) LIGHTING FIXTURE

FIELD OF THE INVENTION

The present invention relates to a lighting fixture, in particular to a light-emitting diode (LED) lighting fixture provided with a self-locking reflector.

BACKGROUND OF THE INVENTION

In a lighting fixture in the prior art, a lamp body tends to be fixed on an outer frame by screws or rivets. But the screw fixing means requires a plurality of parts such as screws, nuts and washers and hence has the defects of cumbersome installation, easy falling after repeated assembly and disassembly, and safety hazards. The rivet riveting means requires riveting equipment and larger operating space for stretching and riveting, is hard to disassemble the lighting fixture after riveting, and hence is very inconvenient.

SUMMARY OF THE INVENTION

Therefore, the objective of the present invention is to provide an LED lighting fixture having the advantages of simple structure and fast installation.

The present invention relates to an LED lighting fixture, which comprises a radiator, a housing covering the radiator, and an LED module mounted at the bottom of the radiator, and further comprises a lamp holder being fixed on the top of the radiator and running through the housing, an elastic element clamped between the lamp holder and the housing, and a lamp shade encircling the LED module; the radiator includes a chassis, a body extended upwards from the chassis, and a plurality of radiating fins extended from a side surface of the body; one side of the radiator close to the bottom is provided with a recess; in the process of assembly, the housing moves up relative to the lamp holder so as to compress the elastic element clamped between the lamp holder and the housing; after the lamp shade is inclined for a predetermined angle relative to the radiator, the lamp shade moves and is sleeved into the chassis and is overturned and straightened until one side of the lamp shade is embedded into the recess of the radiator; and after the housing is loosened, the housing moves down under the reaction thrust of the elastic element and leans against the lamp shade, so that the top of the lamp shade can be fixed between the housing and the chassis of the radiator.

Moreover, the top of the lamp shade is provided with a radially extended sleeved portion and an embedded portion axially extended upwards from an inner edge of the sleeved portion; and both the sleeved portion and the embedded portion are circularly arranged.

Moreover, the chassis of the radiator is provided with a longitudinal minor axis and a transverse major axis; the recess of the radiator is formed at one end corresponding to the major axis of the chassis; and the inside diameter of the embedded portion is less than the major axis of the chassis and greater than the minor axis.

Moreover, the recess of the radiator is V-shaped as seen from the horizontal front view and includes a lower inclined wall and an upper inclined wall; and an angle formed between the lower inclined wall of the recess and the chassis is 30 to 60 degrees.

Moreover, the angle formed between the lower inclined wall of the recess and the chassis is 45 degrees.

Moreover, an angle formed between the lower inclined wall and the upper inclined wall is 80 to 120 degrees.

Moreover, the angle formed between the lower inclined wall and the upper inclined wall is 90 degrees.

Moreover, an accommodating portion is concave down from a top central section of the housing; and the bottom of the accommodating portion leans against the top of the radiator.

Moreover, the lamp holder is cylindrically arranged; a central section of the lamp holder is provided with a center hole running through vertically; a flange is extended from the top of the lamp holder; the elastic element is sleeved on the lamp holder; and both ends of the elastic element respectively lean against the bottom of the accommodating portion and the flange of the lamp holder.

Moreover, the LED lighting fixture further comprises an electric wire which is electrically connected with the LED module and transverses upwards through the radiator and the lamp holder.

Compared with the prior art, in the LED lighting fixture provided by the present invention, as the elastic element is disposed between the housing and the lamp holder, the housing can move up and down telescopically relative to the lamp holder so as to elastically fix the lamp shade mounted from the lower portion on the chassis of the radiator, and hence the lamp shade is simple and convenient in assembly and disassembly.

DETAILED DESCRIPTION OF THE PREFERRED EMBODIMENTS

For more clear expression of the technical proposals of the present invention, further description will be given below to the present invention with reference to the accompanying drawings.

Figure 1:
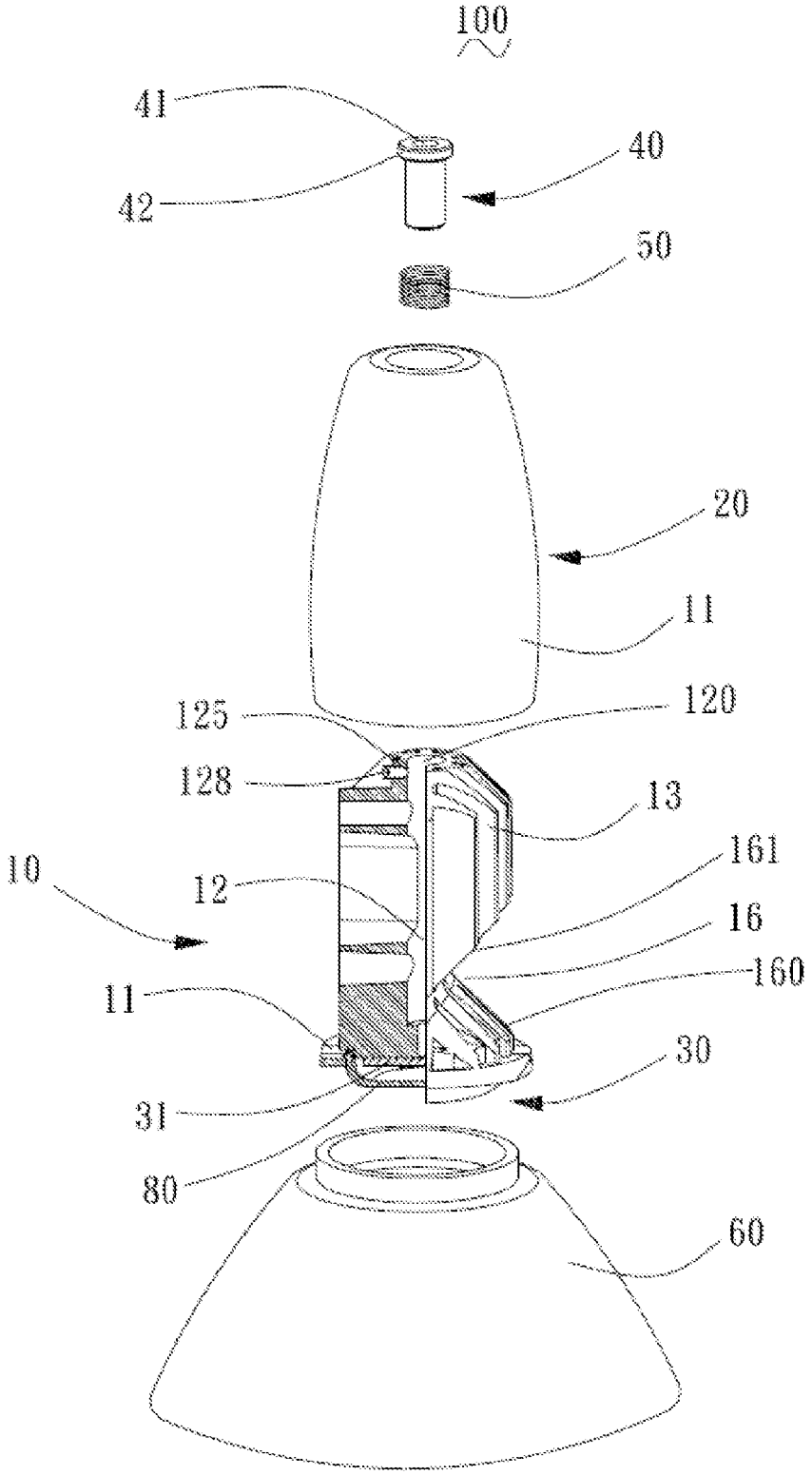
FIG. 1 is a perspective exploded view of an LED lighting fixture provided by a preferred embodiment of the present invention, in which a radiator and an LED module are partially cut away.
Figure 2:
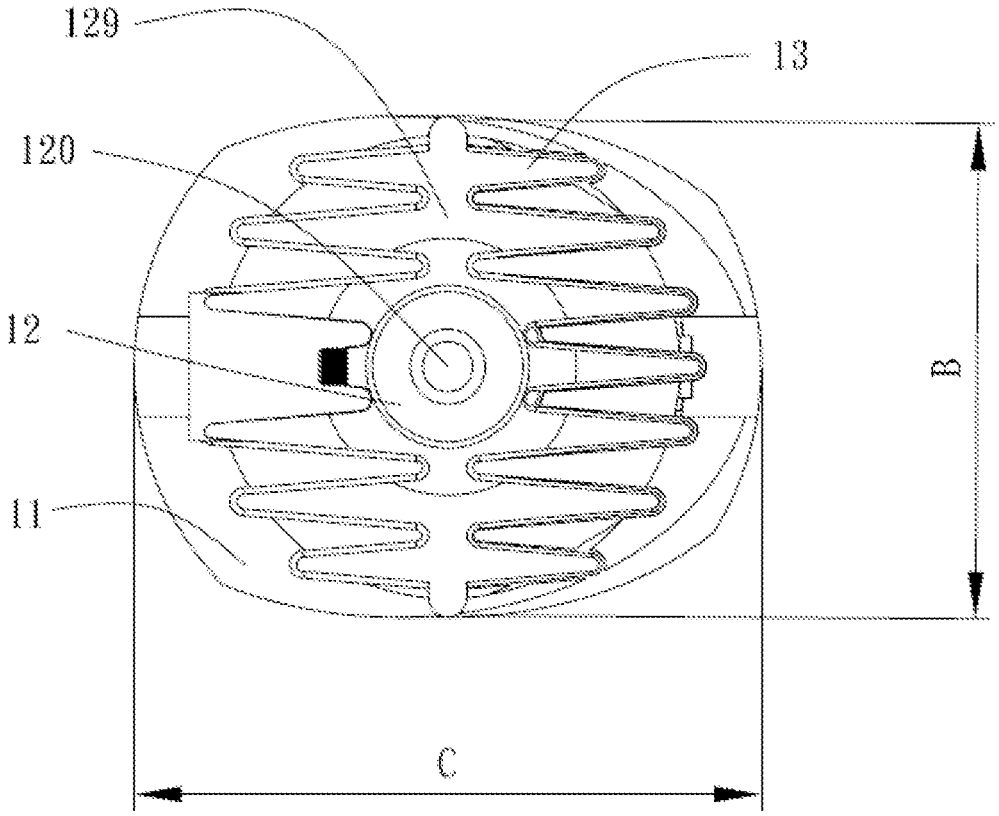
FIG. 2 is a top view of the LED lighting fixture as shown in FIG. 1, in which the radiator is not cut away.
Figure 3:
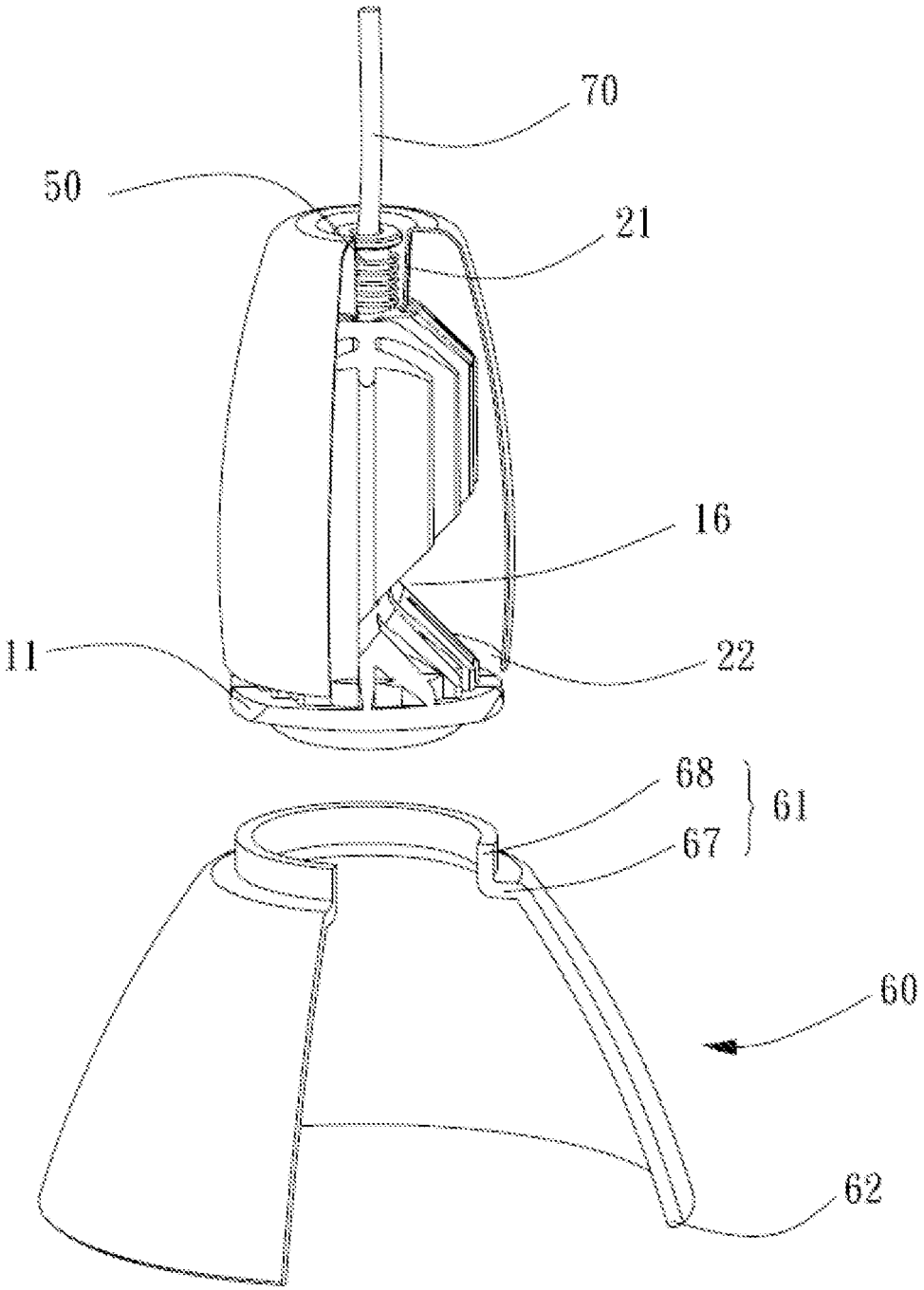
FIG. 3 is a partial assembly drawing of the LED lighting fixture as shown in FIG. 1, in which a housing and a lamp shade of the LED lighting fixture are partially cut away.
Figure 4:
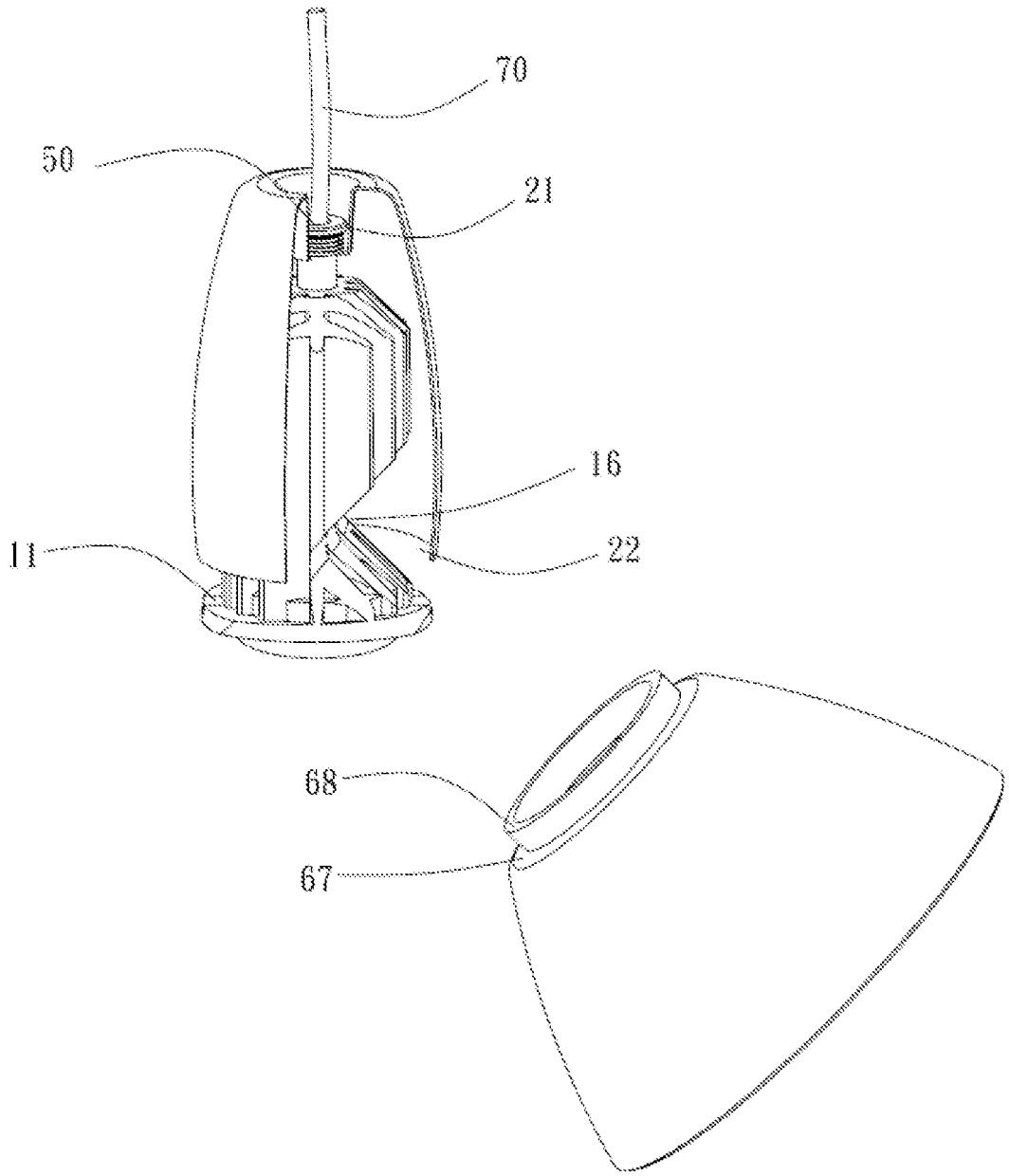
FIG. 4 is a partial assembly drawing of the LED lighting fixture as shown in FIG. 1, in which the housing of the LED lighting fixture is partially cut away and the lamp shade is inclined.
Figure 5:
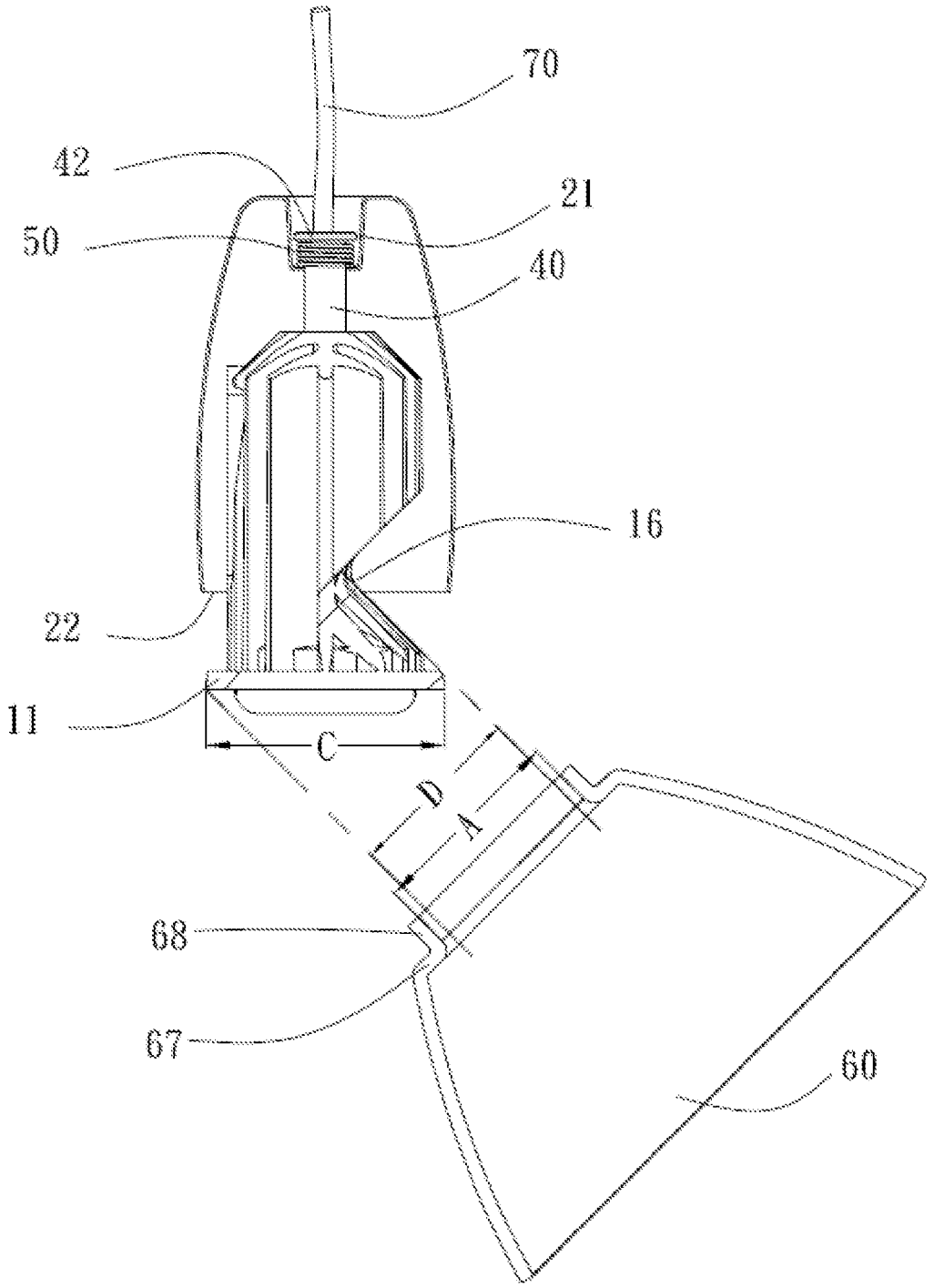
FIG. 5 is a front view of the LED lighting fixture as shown in FIG. 4, in which the housing and the lamp shade of the LED lighting fixture are cut away in half.
Figure 6:
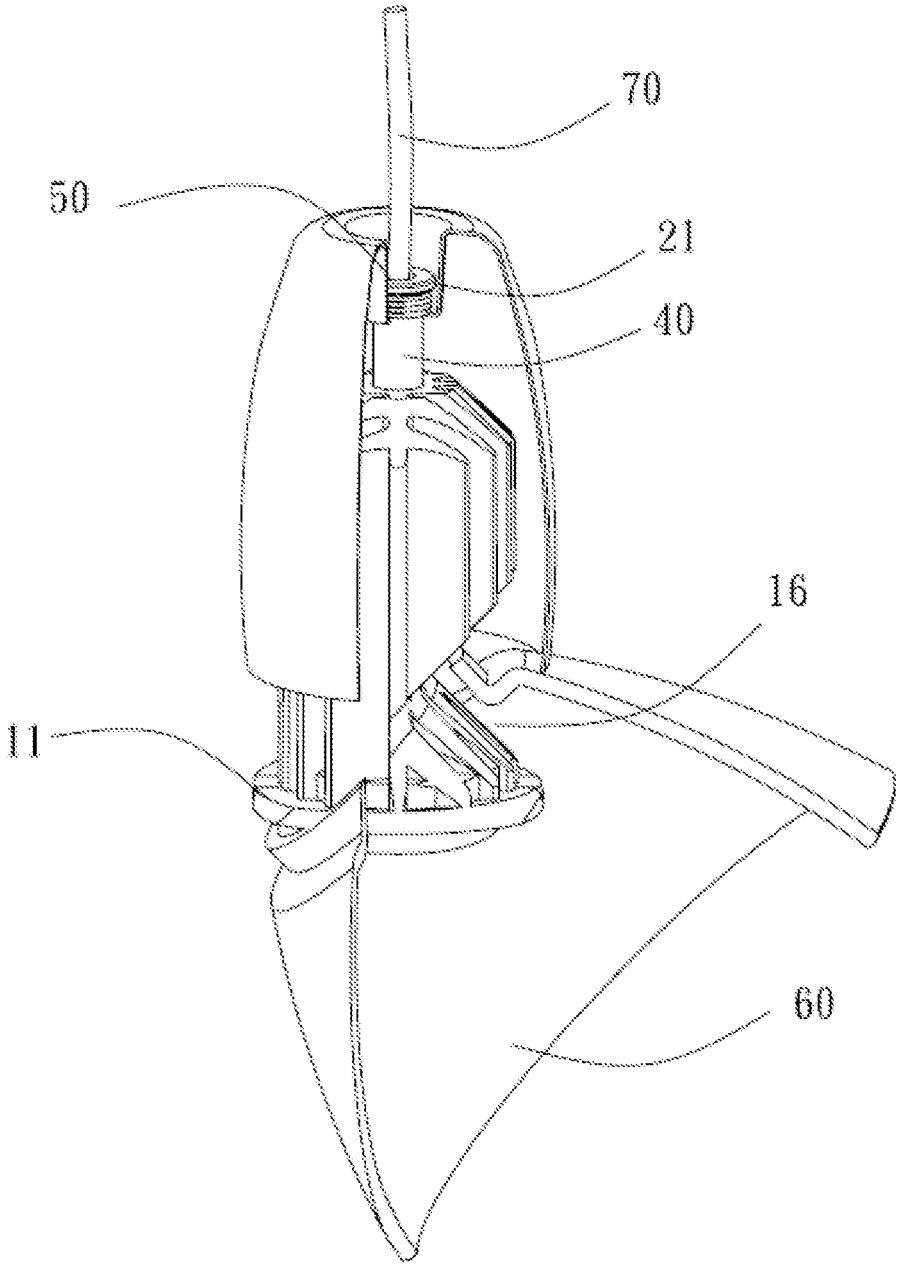
FIGS. 6 to 8 are schematic diagrams illustrating the assembly process of the LED lighting fixture as shown in FIG. 4.
Figure 7:
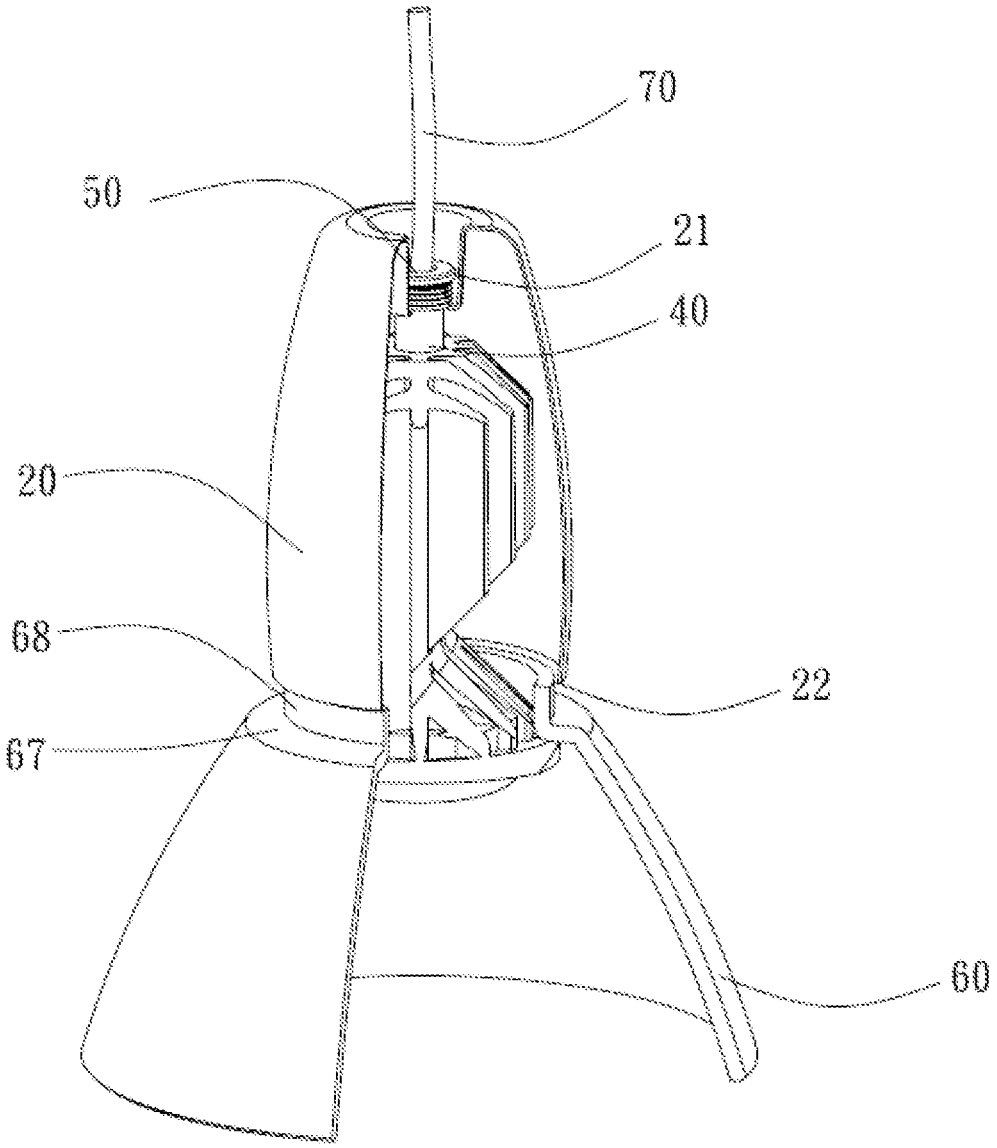
Figure 8:
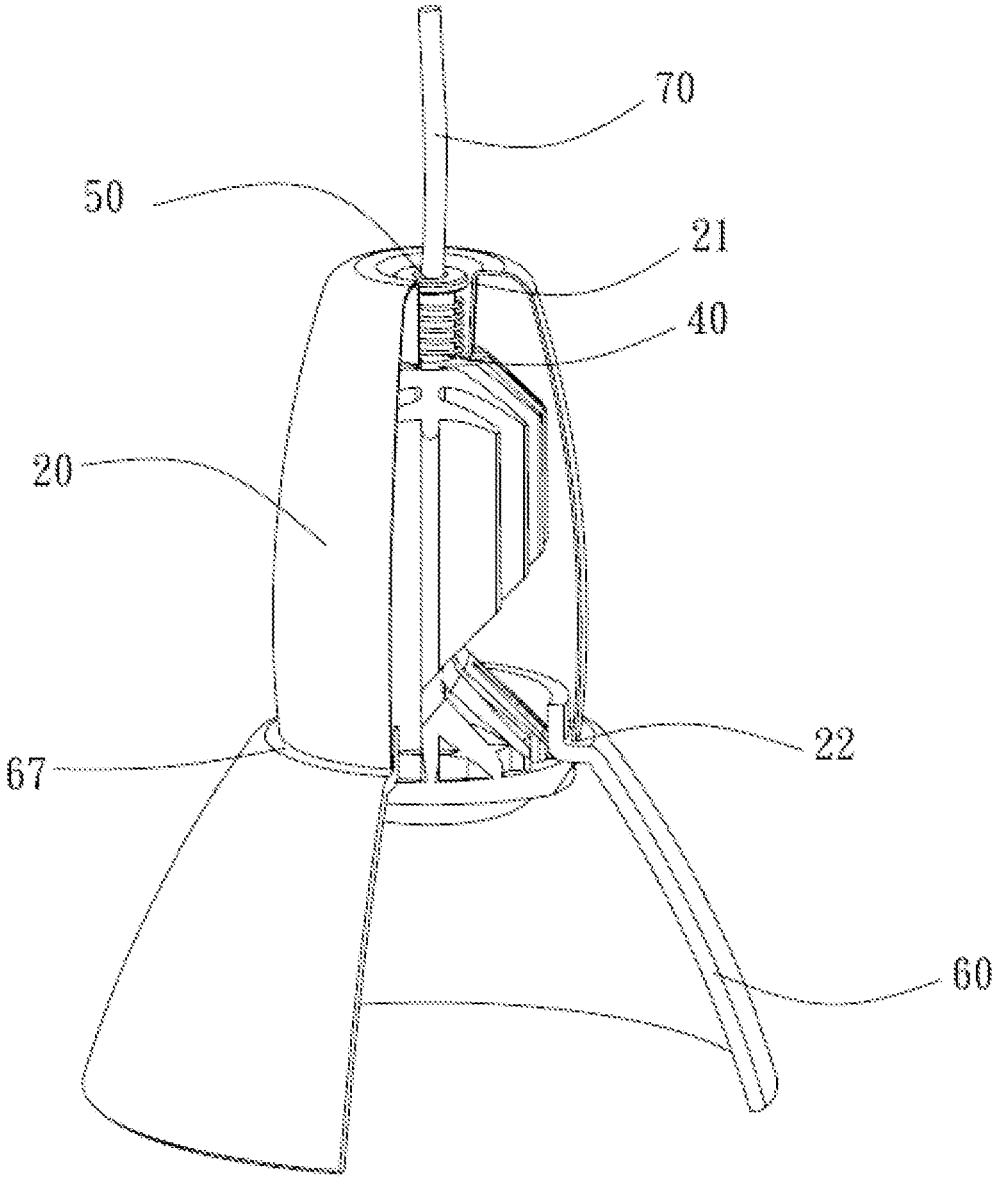

As illustrated in FIGS. 1 to 8, an LED lighting fixture 100 provided by a preferred embodiment of the present invention is provided. The LED lighting fixture 100 comprises a radiator 10, a housing 20 covering the radiator 10, an LED module 30 mounted at the bottom of the radiator 10, a lamp holder 40 being fixed on the top of the radiator 10 and running through the housing 20, an elastic element 50 clamped between the lamp holder 40 and the housing 20, and a lamp shade 60 encircling the LED module 20. The elastic element 50 elastically extrudes the housing 20 so as to fix the lamp shade 60 at the bottom of the radiator 10. In the embodiment, the LED lighting fixture 100 is a chandelier.

The radiator 10 includes a chassis 11, a body 12 extended upwards from the chassis 11, and a plurality of radiating fins 13 extended from a side surface of the body 12. The chassis 11 is non-circular and is approximately elliptical in the embodiment. The chassis 11 is provided with a longitudinal minor axis B and a transverse major axis C. The length of the minor axis B is less than that of the major axis C. In the embodiment, the radio of the minor axis B to the major axis C is 0.6 to 0.9.

A central section of the body 12 is provided with a mounting hole 120 running through vertically; a top side wall of the body 12 is provided with a fixing hole 125 transversely communicated with the mounting hole 120; the fixing hole 125 is provided with a fixing element 128 to fix the lamp holder 40 inserted into the mounting hole 120; and it could be understood that the effect of fixing the lamp holder 40 into the mounting hole 120 may be achieved by forming threads on an outer wall of the lamp holder 40 and an inner wall of the mounting hole 120.

The body 12 includes a longitudinally arranged extension board 129. The radiating fins 13 are vertically and transversely extended relative to two side surfaces of the extension board 129. In the embodiment, each radiating fin 13 is extended in the vertical direction so as to form a gas channel to enhance the radiating effect. One side of the radiator 10 close to the bottom is provided with a recess 16; the recess 16 is formed at one end corresponding to the major axis of the chassis 11, is V-shaped as seen from the horizontal front view, and includes a lower inclined wall 160 and an upper inclined wall 161; and an angle formed between the lower inclined wall 160 of the recess 16 and the chassis 11 is 30 to 60 degrees. In the embodiment, the angle formed between the lower inclined wall 160 of the recess 16 and the chassis 11 is 45 degrees. Moreover, an angle formed between the lower inclined wall 160 and the upper inclined wall 161 is 80 to 120 degrees. In the embodiment, the angle formed between the lower inclined wall 160 and the upper inclined wall 161 is 90 degrees.

The housing 20 is in the shape of an inverted cup; an accommodating portion 21 is concave down from a top central section of the housing 20; the bottom of the accommodating portion 21 leans against the top of the radiator 10; a central section of the accommodating portion 21 is provided with a through hole for the alignment to the mounting hole 120 of the radiator 10; the elastic element 50 is accommodated in the accommodating portion 21; and the bottom of the housing 20 is provided with an opening 22. In the embodiment, the opening 22 is circular.

The lamp holder 40 is cylindrically arranged; a central section of the lamp holder 40 is axially provided with a center hole 41 running through vertically; and the top of the lamp holder 40 is provided with a flange 42 for the downward blocking of the top of the elastic element 50.

In the embodiment, the elastic element 50 is a spring.

The LED module 30 includes a circuit board and a plurality of LEDs (not shown in the figure) electrically connected to the lower portion of the circuit board 31, and is fixed on a bottom surface of the chassis 11 of the radiator 10. The LED lighting fixture 100 further comprises an electric wire 70 which is electrically connected with the LED module 30 and transverses upwards through the mounting hole 120 of the radiator 10 and the center hole 41 of the lamp holder 40. The LED lighting fixture 100 further comprises a light-admitting cover 80 fixed on the chassis 11 of the radiator 10 and configured to cover and protect the LED module 30.

The lamp shade 60 is in the shape of a trumpet and includes a top end 61 and a bottom end 62. The top end 62 includes a radially extended sleeved portion 67 and an embedded portion 68 axially extended upwards from an inner edge of the sleeved portion 67; both the sleeved portion 67 and the embedded portion 68 are circularly arranged; and the inside diameter A of the embedded portion 68 is less than the major axis C of the chassis 11 and greater than the minor axis B, namely C>A>B. When the lamp shade 60 is inclined for a certain angle between 30 and 60 degrees relative to the radiator 10, the inside diameter A of the embedded portion 68 is greater than the width D of a projection of the major axis C of the chassis 11 to the inclination angle, so that the lamp shade 60 can be sleeved into the chassis 11 by means of inclining. It could be understood that the inclination angle of the lamp shade 60 is not necessarily only 30 to 60 degrees and other angles also fall within the scope of protection of the present invention as long as the lamp shade 60 can be sleeved into the chassis 11 after inclining and the process of installation can be completed.

In the process of assembly of other parts except the lamp shade 60 of the LED lighting fixture 100, firstly, the housing 20 sleeves the radiator 10 from the top down, so that the bottom of the accommodating portion 21 of the housing 20 can lean against the top of the radiator 10; secondly, after the elastic element 50 is sleeved into the lamp holder 40, the lamp holder 40 runs through the opening 22 of the housing 20 and is fixed into the mounting hole 120 of the radiator 10, in which in the embodiment, the means of fixing the lamp holder 40 into the mounting hole 120 is to fix the lamp holder 40 by tightening the fixing element 128 by an external tool; in other embodiments, the lamp holder 40 may be in threaded connection with the radiator 10 or connected with the radiator 10 by other means; and thirdly, the electric wire 70 lifts assembled parts.

When the lamp shade 60 is to be mounted on the radiator 10, firstly, the housing 20 moves up relative to the lamp holder 40 to compress the elastic element 50 clamped between the flange 42 of the lamp holder 40 and the bottom of the accommodating portion 21 of the housing 20; secondly, the lamp shade 60 is inclined for a predetermined angle relative to the radiator 10, namely certain angle from 30 to 60 degrees in the embodiment, and moves obliquely towards the radiator 10 until one side of the embedded portion 68 and one side of the sleeved portion 67 are embedded into the recess 16 of the radiator 10; thirdly, the lamp shade 60 is overturned and straightened so that the sleeved portion 67 of the lamp shade 60 can be completely disposed above the chassis 11 of the radiator 10, and a bottom surface of the sleeved portion 67 leans against a top surface on the periphery of the chassis 11 due to the gravity of the lamp shade 60 after loosening; and fourthly, the housing 20 moves down under the reaction thrust of the elastic element 50 and leans against a top surface of the sleeved portion 67 of the lamp shade 60, so that the lamp shade 60 can be fixed between the housing 20 and the chassis 11 of the radiator 10.

In the LED lighting fixture 100 provided by the present invention, as the elastic element 50 is disposed between the housing 20 and the lamp holder 40, the housing 20 can move up and down telescopically relative to the lamp holder 40, so that the housing 20 can elastically fix the lamp shade 60 mounted from the lower portion on the chassis 11 of the radiator 10, and hence the lamp shade 60 is simple and convenient in assembly and disassembly.

The foregoing embodiments are only preferred embodiments of the present invention. Although specifically described in detail, the foregoing embodiments could not be construed as the limitation of the scope of the invention patent. It should be noted that various deformations and modifications may be made by those skilled in the art without departing from the concept of the present invention and should all fall within the scope of protection of the present invention. Therefore, the scope of protection of the invention patent should be defined by the appended claims.

What is claimed is:

1. A light-emitting diode (LED) lighting fixture, comprising a radiator, a housing covering the radiator, and an LED module mounted at the bottom of the radiator, wherein the LED lighting fixture further comprises a lamp holder being fixed on the top of the radiator and running through the housing, an elastic element clamped between the lamp holder and the housing, and a lamp shade encircling the LED module; the radiator includes a chassis, a body extended upwards from the chassis, and a plurality of radiating fins extended from a side surface of the body; one side of the radiator close to the bottom is provided with a recess; in the process of assembly, the housing moves up relative to the lamp holder so as to compress the elastic element clamped between the lamp holder and the housing; after the lamp shade is inclined for a predetermined angle relative to the radiator, the lamp shade moves and is sleeved into the chassis and is overturned and straightened until one side of the lamp shade is embedded into the recess of the radiator; and after the housing is loosened, the housing moves down under the reaction thrust of the elastic element and leans against the lamp shade, so that the top of the lamp shade can be fixed between the housing and the chassis of the radiator.

2. The lighting fixture according to claim 1, wherein the top of the lamp shade is provided with a radially extended sleeved portion and an embedded portion axially extended upwards from an inner edge of the sleeved portion; and both the sleeved portion and the embedded portion are circularly arranged.

3. The lighting fixture according to claim 2, wherein the chassis of the radiator is provided with a longitudinal minor axis and a transverse major axis; the recess of the radiator is formed at one end corresponding to the major axis of the chassis; and the inside diameter of the embedded portion is less than the major axis of the chassis and greater than the minor axis.

4. The lighting fixture according to claim 1, wherein the recess of the radiator is V-shaped as seen from the horizontal front view and includes a lower inclined wall and an upper inclined wall; and an angle formed between the lower inclined wall of the recess and the chassis is 30 to 60 degrees.

5. The lighting fixture according to claim 4, wherein the angle formed between the lower inclined wall of the recess and the chassis is 45 degrees.

6. The lighting fixture according to claim 4, wherein an angle formed between the lower inclined wall and the upper inclined wall is 80 to 120 degrees.

7. The lighting fixture according to claim 6, wherein the angle formed between the lower inclined wall and the upper inclined wall is 90 degrees.

8. The lighting fixture according to claim 1, wherein an accommodating portion is concave down from a top central section of the housing; and the bottom of the accommodating portion leans against the top of the radiator.

9. The lighting fixture according to claim 8, wherein the lamp holder is cylindrically arranged; a central section of the lamp holder is provided with a center hole running through vertically; a flange is extended from the top of the lamp holder; the elastic element is sleeved on the lamp holder; and both ends of the elastic element respectively lean against the bottom of the accommodating portion and the flange of the lamp holder.

10. The lighting fixture according to claim 1, further comprising an electric wire which is electrically connected with the LED module and transverses upwards through the radiator and the lamp holder.

* * * * *